US009592939B2

(12) United States Patent
Mesina

(10) Patent No.: US 9,592,939 B2
(45) Date of Patent: Mar. 14, 2017

(54) APPARATUS TO FILL LIQUID INTO A CONTAINER

(71) Applicant: Fred Mesina, Belmont, CA (US)

(72) Inventor: Fred Mesina, Belmont, CA (US)

(73) Assignee: Fred Mesina, San Francisco, CA (US)

( * ) Notice: Subject to any disclaimer, the term of this patent is extended or adjusted under 35 U.S.C. 154(b) by 2 days.

(21) Appl. No.: 14/741,037

(22) Filed: Jun. 16, 2015

(65) Prior Publication Data

US 2016/0368672 A1 Dec. 22, 2016

(51) Int. Cl.
*B65D 47/06* (2006.01)
*B65D 1/02* (2006.01)

(52) U.S. Cl.
CPC ..... *B65D 47/06* (2013.01); *B65D 1/023* (2013.01)

(58) Field of Classification Search
CPC ..... B65D 47/06; B65D 1/023
USPC ..... 215/229, 388; 220/705, 706, 707, 708, 220/709
See application file for complete search history.

(56) References Cited

U.S. PATENT DOCUMENTS 5,223,566 A * 6/1993 Aida ..... C08K 5/01 524/451
5,226,566 A * 7/1993 Brandenburg ..... A47K 5/1205 222/180
6,467,651 B1 * 10/2002 Muderlak ..... A47K 5/1217 222/333
8,851,324 B2 * 10/2014 O'Sullivan ..... A47G 19/2222 220/710
2002/0185500 A1 * 12/2002 Muderlak ..... A47K 5/1217 222/1
2003/0102318 A1 * 6/2003 Lee ..... B65D 47/066 220/705

* cited by examiner

*Primary Examiner* — Robert J Hicks
*Assistant Examiner* — Kareen Thomas
(74) *Attorney, Agent, or Firm* — Benjamin A. Kimes; Lowenstein Sandler LLP

(57) ABSTRACT

An apparatus includes a container comprising an opening, a cap to detachably enclose the opening, and a conduit, attached to the cap, comprising a first passageway and a second passageway, both the first passageway and the second passageway connecting an interior space of the container to an exterior space of the container, wherein a length of the first passageway is greater than a length of the second passageway.

19 Claims, 7 Drawing Sheets

APPARATUS TO FILL LIQUID INTO A CONTAINER

TECHNICAL FIELD

This disclosure relates to an apparatus and method to fill a fluid dispenser, in particular, to an apparatus and method to refill a fluid dispenser mounted to a countertop.

BACKGROUND

Fluid dispensers typically include a reservoir and a pump head. Certain types of fluid dispensers are designed to be mounted on countertops. The fluid reservoir of these types of fluid dispensers are installed under the countertop and the pump head including a pump connected to the fluid reservoir through a narrow pathway is installed above the countertop. For example, a kitchen dish soap dispenser may include a liquid soap reservoir mounted under a kitchen countertop and concealed by a kitchen cabinet. Further, the kitchen dish soap dispenser may include a pump head mounted above the countertop. The pump head may include a lever and an outlet that is connected to the fluid reservoir through a tube. A user may press the lever to pump the liquid soap out of the liquid soap reservoir through the tube.

To refill the liquid soap reservoir when the liquid soap in it is used up, the user needs to un-mount the liquid soap reservoir from a mounting point underneath the countertop, fill up the liquid soap reservoir, and then mount the liquid soap reservoir back to the mounting point. Because the liquid soap dispensers are often installed towards a wall or a corner behind plumbing pipes, the access to the liquid soap reservoirs is sometimes inconvenient, and the user may need to carry out the un-mount and mount of the liquid soap reservoir without the benefit of direct line of sight of the mounting point.

Alternatively, the user may unscrew the pump head and try to refill the liquid soap reservoir from the above of the countertop through an opening exposing the narrow pathway. Because the pathway leading to the liquid soap reservoir is typically very narrow, the air pressure in the emptied liquid soap reservoir may prevent pouring liquid soap directly into the liquid soap reservoir from above the countertop. Further, because the user cannot see how much liquid soap has been added to the reservoir mounted underneath the countertop, refilling by direct pouring into the liquid soap reservoir from above the countertop may cause overflows.

SUMMARY

The following is a simplified summary of the disclosure in order to provide a basic understanding of some aspects of the disclosure. This summary is not an extensive overview of the disclosure. It is intended to neither identify key or critical elements of the disclosure, nor delineate any scope of the particular implementations of the disclosure or any scope of the claims. Its sole purpose is to present some concepts of the disclosure in a simplified form as a prelude to the more detailed description that is presented later.

Implementations of the present disclosure relate to an apparatus including a container comprising an opening, a cap to detachably enclose the opening, and a conduit, attached to the cap, comprising a first passageway and a second passageway, both the first passageway and the second passageway connecting an interior space of the container to an exterior space of the container, wherein a length of the first passageway is greater than a length of the second passageway.

Implementations of the present disclosure relate to an apparatus including a cap to enclose a container and a conduit, attached to the cap, comprising a first passageway and a second passageway, wherein a length of the first passageway is substantially greater than a length of the second passageway.

Implementations of the present disclosure relate to a bottle for refilling a fluid dispenser, the bottle including a body to store fluid, a sprout tube to connect an interior of the container to exterior, wherein the sprout tube comprises a first portion outside the body and a second portion inside the body, and a breather tube to connect the interior of the container to the exterior, wherein the breather tube comprises a first portion outside the body and a second portion inside the body, wherein the second portion of the breather tube is substantially longer than the second portion of the sprout tube.

BRIEF DESCRIPTION OF THE DRAWINGS

The present disclosure is illustrated by way of example, and not by way of limitation, in the figures of the accompanying drawings.

DETAILED DESCRIPTION

Implementations of the present disclosure include apparatuses and methods to fill a container such as, for example, the reservoir of a fluid dispenser that is mounted underneath a countertop. Implementations of the present disclosure allow for rapid refills of the container and an automatic stop when the fluid is filled up to a pre-determined level. Thus, implementations of the present disclosure allow for quick and spill-free refills of fluid dispenser mounted on a countertop without the slow-fill problem caused by internal air pressure and the over-fill problem caused by not being able to see the fill level in the reservoir of a countertop-mounted fluid dispenser.

Figure 1:
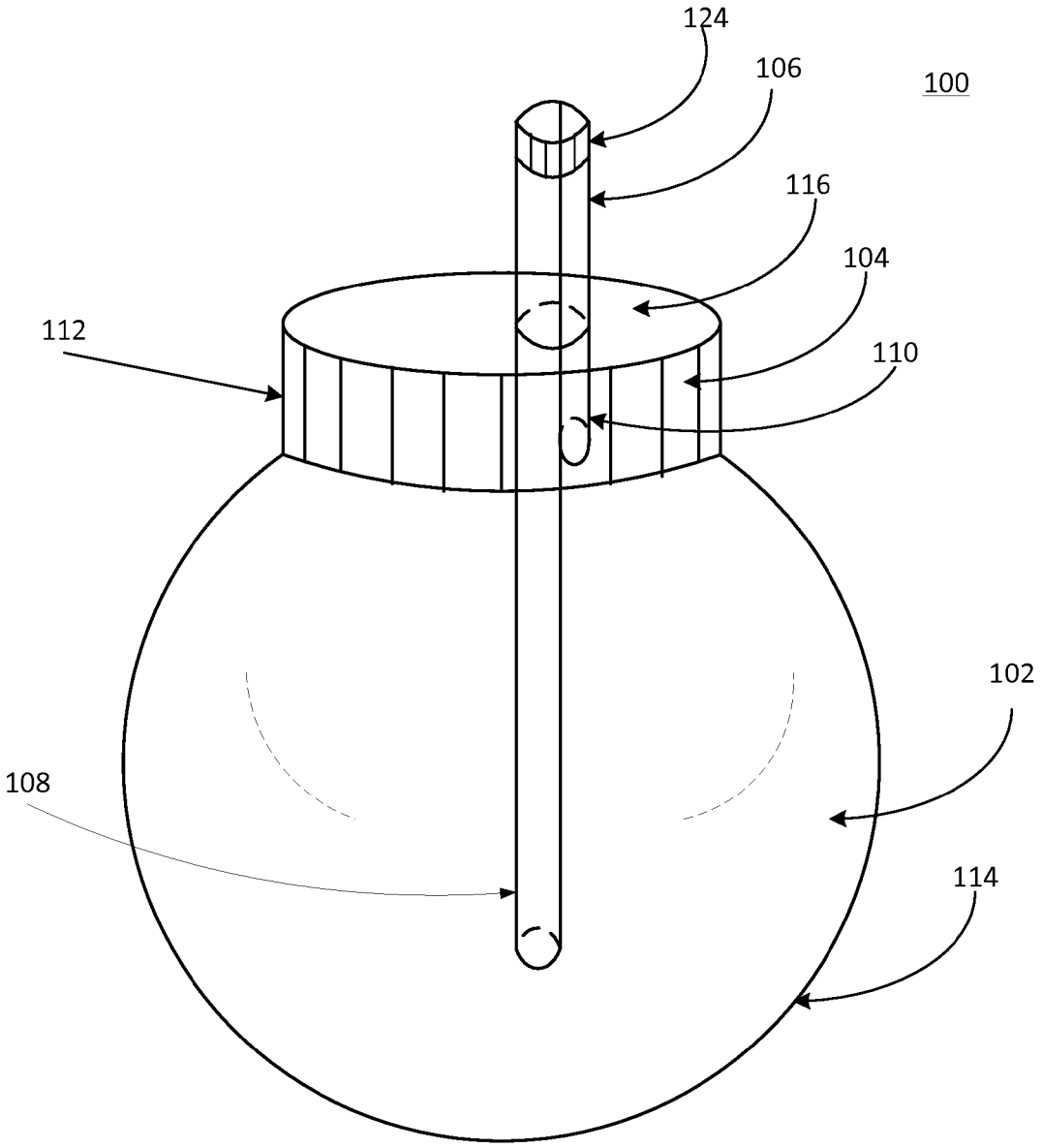
FIG. 1 illustrates a refill bottle according to some implementations of the present disclosure.

FIG. 1 illustrates a refill bottle 100 according to some implementations of the present disclosure. The refill bottle 100 may store fluid such as, for example, liquid dish soap that is to be filled into a reservoir of a fluid dispenser. Referring to FIG. 1, refill bottle 100 may include a container 102, a cap 104, and a conduit 106. The container 102 may be any suitable object that is made of suitable materials and holds a certain amount of fluid. In one implementation, the container 102 may be a plastic bottle. The container 102 may include a neck portion 112 and a body portion 114. The neck portion 112 may provide an opening 116 to the container 102. A fluid such as, for example, liquid dish soap may be filled into the container 102 through the opening 116. Further, the neck portion 112 may serve as a receptor to the cap 104.

The cap 104 may be an object that may be made of suitable materials and attached to the container 102 at the opening 116 to enclose the container 102. In one implementation, the cap 104 may be a plastic cover with a lid and may be screwed onto or pressed onto the neck portion 112. When the cap 104 is attached to the container 102, the container 102 and the cap 104 may enclose a volume of space within the refill bottle 100. The volume enclosed by the container 102 and the cap 104 may constitute an interior space of the refill bottle 100 that is separated from an exterior space outside the refill bottle 100. Certain fluid may be stored in the enclosed refill bottle 100.

In one implementation, a conduit 106 may be coupled to the cap 102 to provide passageways between the interior space and the exterior space of the refill bottle 100. The conduit 106 can be made of any suitable material such as, for example, plastic or rubber. In one implementation, the conduit 106 may include a first passageway 108 and a second passageway 110. Each of the first and second passageways 108, 110 may provide a respective channel that connects the interior space to the exterior space with respect to the refill bottle 100. In one implementation, the first and second passageways are two respective elongated tubes that have different lengths.

In one implementation, the first passageway 108 is a breather tube having a certain length and being fixedly attached to the cap 104. As shown in FIG. 1, the first passageway 108 passes through the cap 104 and includes a first portion outside the refill bottle 100 and a second portion inside the refill bottle 100. The first passageway 108 may provide air flows between a first end terminating the first portion and a second end terminating the second portion.

During a refill, the first end of the first passageway 108 may be inserted into a container (such as the fluid reservoir mounted underneath a countertop) to be filled while the second end of the first passageway is in the refill bottle 100 that contains the fluid. In one implementation, the first passageway 108 is long enough to allow the second end of the first passageway 108 to be located near the bottom of the refill bottle 100. When the refill bottle 100 is turned upside down to refill the empty reservoir mounted underneath a countertop, the second end of the first passageway is above the fluid level in the container 102. Thus the air volume toward the bottom of the refill bottle is connected by the first passageway 108 with the air volume in the reservoir, thereby creating air pressure equilibrium between these two containers.

In one implementation, the second passageway 110 is a sprout tube (or a filling tube) through which the fluid stored in refill bottle 100 flows into the reservoir. As shown in FIG. 1, the second passageway 110 passes through the cap 104 and includes a first portion outside the refill bottle 100 and an optional second portion inside the refill bottle 100. The first portion is terminated by a first end, and the second portion is terminated by a second end. In one implementation, the second passageway 110 is substantially shorter than the first passageway 108. Thus the second end of the second passageway 110 is located substantially close to the neck portion of the refill bottle 100. For example, in one implementation, the second end of the sprout tube may be terminated at or substantially near the cap 104. During a refill, the refill bottle 100 is turned upside down to enable the fluid stored in the container 102 to flow into the reservoir of a fluid dispenser. Because the first passageway 108 provides an air passage between the air trapped inside the refill bottle and the air in the reservoir, the air pressure inside the reservoir is at equilibrium with the air pressure in the refill bottle 100. The air pressure equilibrium enables the fluid in the refill bottle to flow freely into the fluid reservoir of the dispenser.

In one implementation, the first portion of the first passageway may have a certain length to allow the first passageway 108 (or the breather tube) to pass through the thickness of a countertop and reach the inside of the fluid reservoir mounted at the mounting point underneath the countertop. The location of the first end terminating the first portion of the first passageway 108 may determine how much fluid is to be filled into the reservoir or the final fill level. In particular, the relative height of the first end of the first passageway with respect to the bottom of the reservoir to be filled approximately determines the final fill level. During a refill, the level of fluid in the reservoir may rise until the fluid level reaches the height of the first end of the first passageway (or the breather tube). When the fluid level reaches the first end of the first passageway, the fluid in the reservoir may flow into the first passageway and shut off the air flow between the chamber of the refill bottle 100 and the chamber of the fluid reservoir. Because there is no further air flow between these two chambers, these two chambers are no longer connected or at the air pressure equilibrium. Any further fluid that flows from the refill bottle 100 to the reservoir may increase the air pressure in the chamber of the reservoir and reduce the air pressure in the chamber of the refill bottle 100. This air pressure difference between these two chambers may increase to a pressure level that may stop the fluid flow from the refill bottle 100 to the reservoir through the second passageway 110 (or the sprout tube), thus achieving an automatic stop of the refill. In this way, implementations of the present disclosure may achieve a quick refill of a fluid dispenser with automatic stop even if the user cannot see the fluid level in the reservoir of the fluid dispenser.

In one implementation, the refill bottle 100 may further include a conduit cap 124 that may seal the external end of the conduit 106. This conduit cap 124 may be attached to the external end of conduit 106. For example, the conduit cap 124 may be screwed on or pressed on conduit 106. Alternatively, the conduit cap 124 may be a cap that may be peeled off the conduit 106. The conduit cap 124 may be useful if the refill bottle is a single-use refill bottle.

Figure 2:
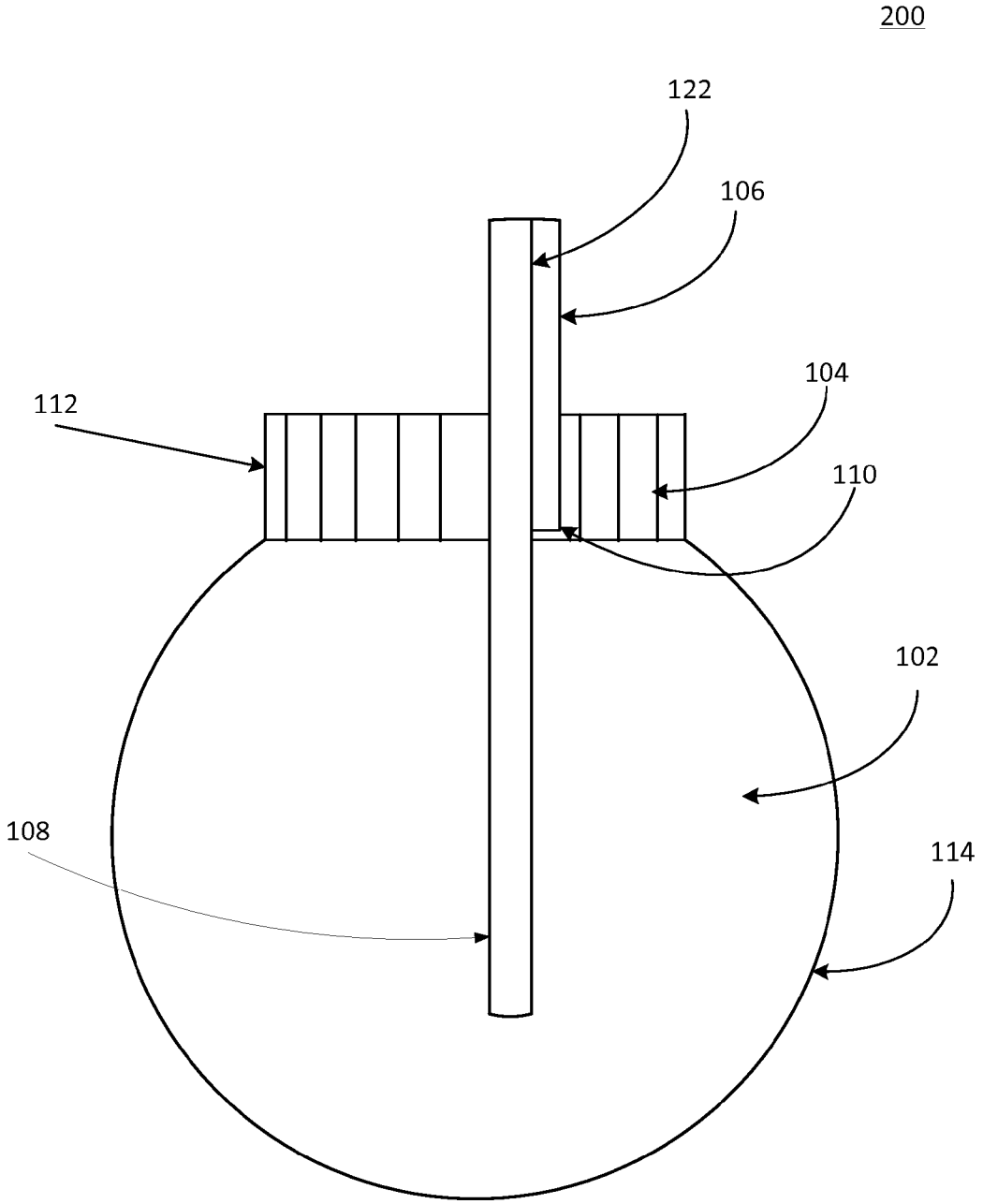
FIG. 2 illustrates a vertical cross-section view of the refill bottle of FIG. 1 according to implementations of the present disclosure.

FIG. 2 illustrates a vertical cross-section view of the refill bottle 100 as shown in FIG. 1 according to implementations of the present disclosure. Referring to FIG. 2, the refill bottle 100 includes a container 102, a cap 104, and a conduit 106 similarly arranged as shown in FIG. 1. The conduit 106 includes a first passageway 108 and a second passageway 110. In one implementation, the conduit 106 may be a pipe, and the first and second passageways 108, 110 are formed by placing a separator 122 in the pipe to produce the separate passageways. In another implementation, the first and second passageways 108, 110 are two separate tubes.

Figure 3:
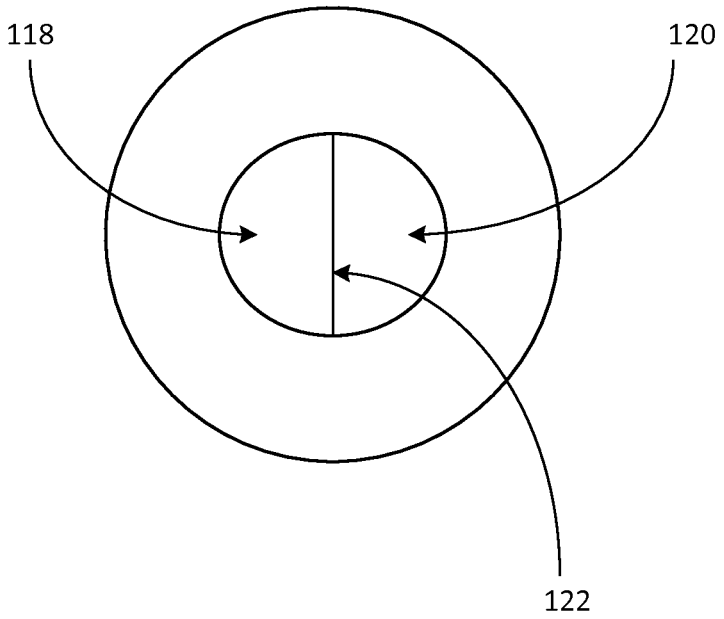
FIG. 3 illustrates a cross-section view of the conduit according some implementations of the present disclosure.

FIG. 3 illustrates a cross-section view of the conduit 106 according some implementations of the present disclosure. As shown in FIG. 3, the cross-section of the conduit 106 may include a first cross-section area 118 for the first passageway 108 and a second cross-section area 120 for the second passageway 110. In one implementation, the first passageway area 118 and the second passageway area 120 are separated by a divider 122. Alternatively, the first passageway 108 and the second passageway 110 are two separate tubes that pass through cap 104 at two separate locations. The first cross-section area 118 for the first passageway may determine the rate of air passing through the first passageway, and the second cross-section area 120 for the second passageway may determine the rate of fluid flow from the refill bottle 100 to the reservoir of a fluid dispenser. In one implementation, the second cross-section area 120 is larger than the first cross-section area 118 to allow a fast refill. In another implementation, the second cross-section area 120 is smaller than the first cross-section area 118 to allow a quick automatic stop when the reservoir is filled up.

Figure 4:
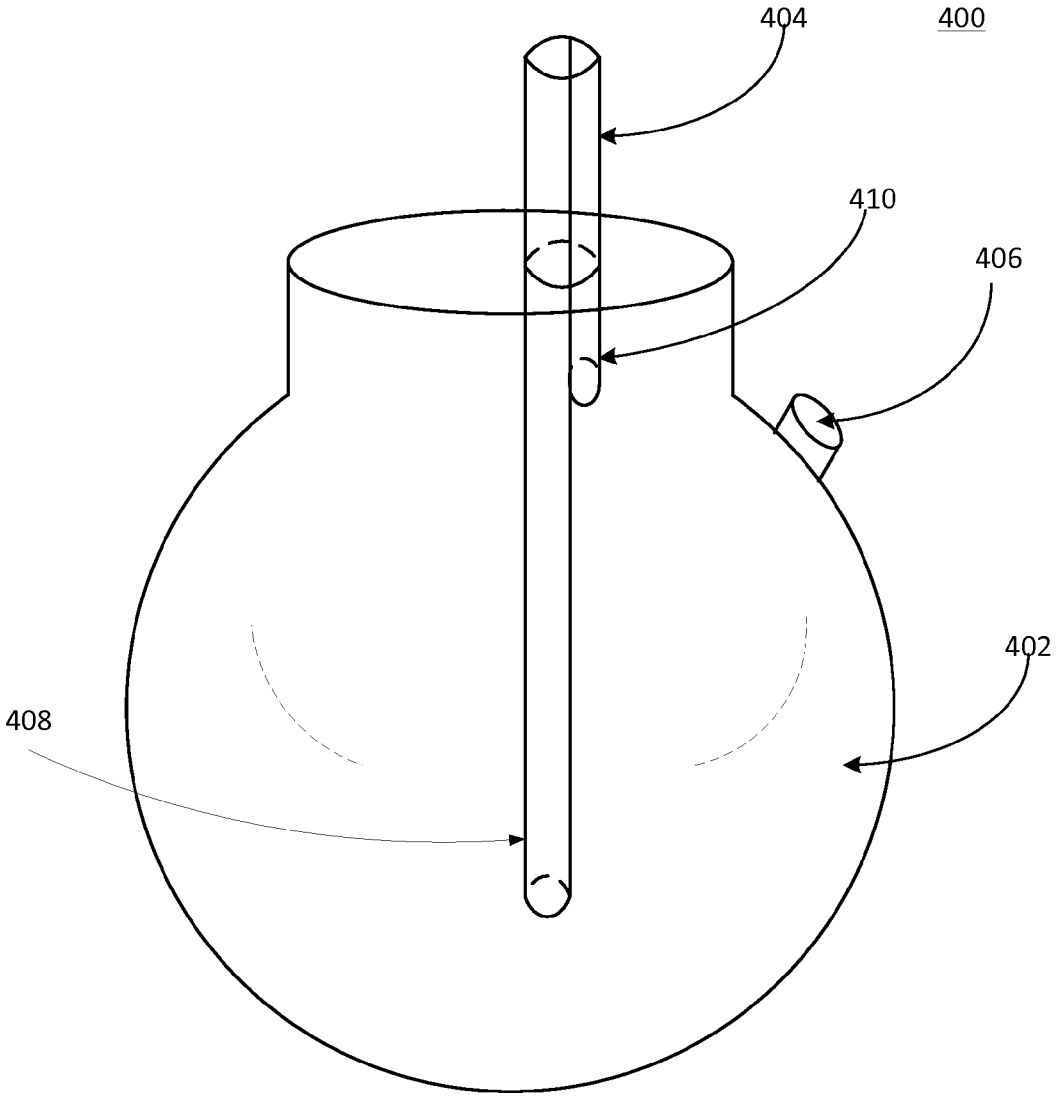
FIG. 4 illustrates a refill bottle according to another implementation of the present disclosure.

Implementations of the present disclosure are not limited to the examples as shown in FIGS. 1-3. Other implementations are also possible. For example, instead of coupling the conduit with the cap, the conduit may be directly coupled to the body of the refill bottle. FIG. 4 illustrates a refill bottle 400 according to another implementation of the present disclosure. As shown in FIG. 4, the refill bottle 400 may include a container 402 and a conduit 404. The refill bottle 400 may be made of any suitable materials. In contrast to the container 102 as shown in FIG. 1, the container 402 may be an integrated object that may be self-enclosed without the need for a cap such as, for example, the cap 104 as shown in FIG. 1. Thus, the container 402 may be self-sealed and the conduit 404 may be directly attached to the container 402 (rather than through a cap).

In one implementation, container 402 may optionally include an outlet 406 to allow filling of the refill bottle 400. As shown in FIG. 4, the outlet 406 may be on the side of the body of container 402 so that the outlet 406 does not interfere with the conduit 404. Alternatively, the body of container 402 may not include an outlet. For example, the refill bottle 400 may be used as a one-time, disposable refill bottle that is used for one refill.

Conduit 404 may be similar to conduit 106 as shown in FIG. 1 and may include a first passageway 408 and a second passageway 410. In one implementation, the first passageway 408 may be a breather tube, and the second passageway 410 may be the sprout tube. The first passageway 408 may have a length longer than that of the second passageway 410. Similar to conduit 106 as shown in FIG. 1, the first passageway 408 may provide an air passage between the chamber of the refill bottle 400 and the chamber of a fluid reservoir that is to be filled. The air passage may create air pressure equilibrium between these two chambers and thus enable free flow from the refill bottle 400 to the reservoir through the second passageway 410 during a refill.

Figure 5A:
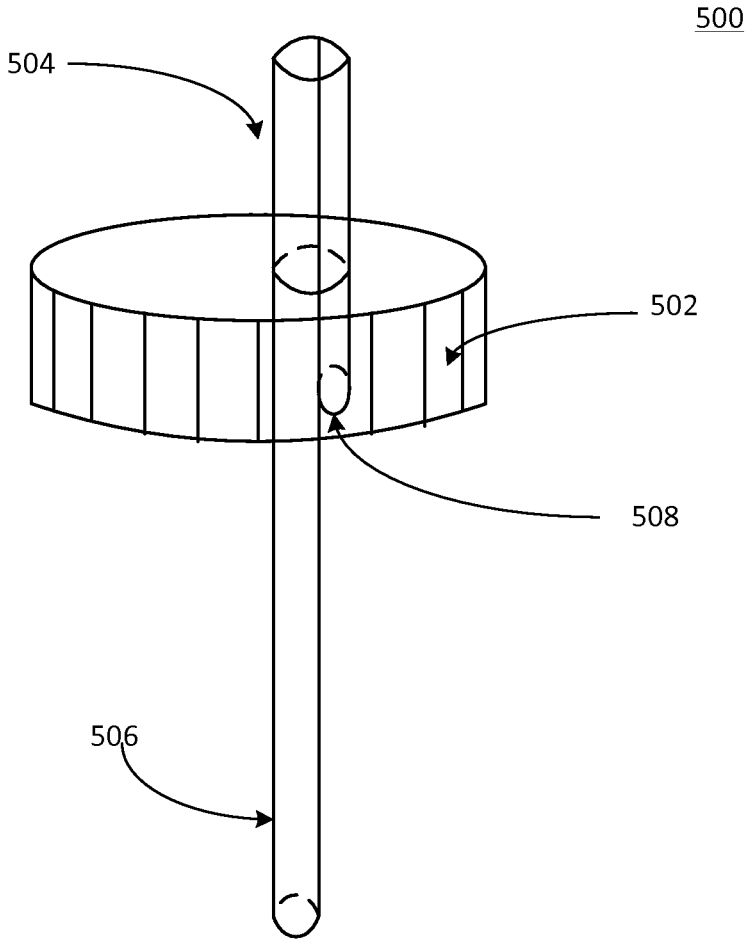
FIG. 5A shows an enclosure device according to an implementation of the present disclosure.

Implementations of present disclosure may include an enclosure device that includes a conduit attached to a cap that may be used to enclose a refill bottle. FIG. 5A shows an enclosure device 500 according to an implementation of the present disclosure. As shown in FIG. 5A, the enclosure device 500 may include a cap 502 and a conduit 504 fixedly attached to the cap 502. Enclosure device 500 may be used to cover (e.g., by screwing on or by pressing on) a container to form a refill bottle. Similar to conduit 106 and conduit 404 as shown in FIGS. 1 and 4, conduit 504 may include a first passageway 506 and a second passageway 508, whereas the first passageway 506 may be the breather tube and the second passageway 508 may be the sprout tube. The first passageway 506 may have a length longer than that of the second passageway 508. The enclosure device 500 may cap a container to form a refill bottle similar to refill bottle 100 as shown in FIG. 1.

Figure 5B:
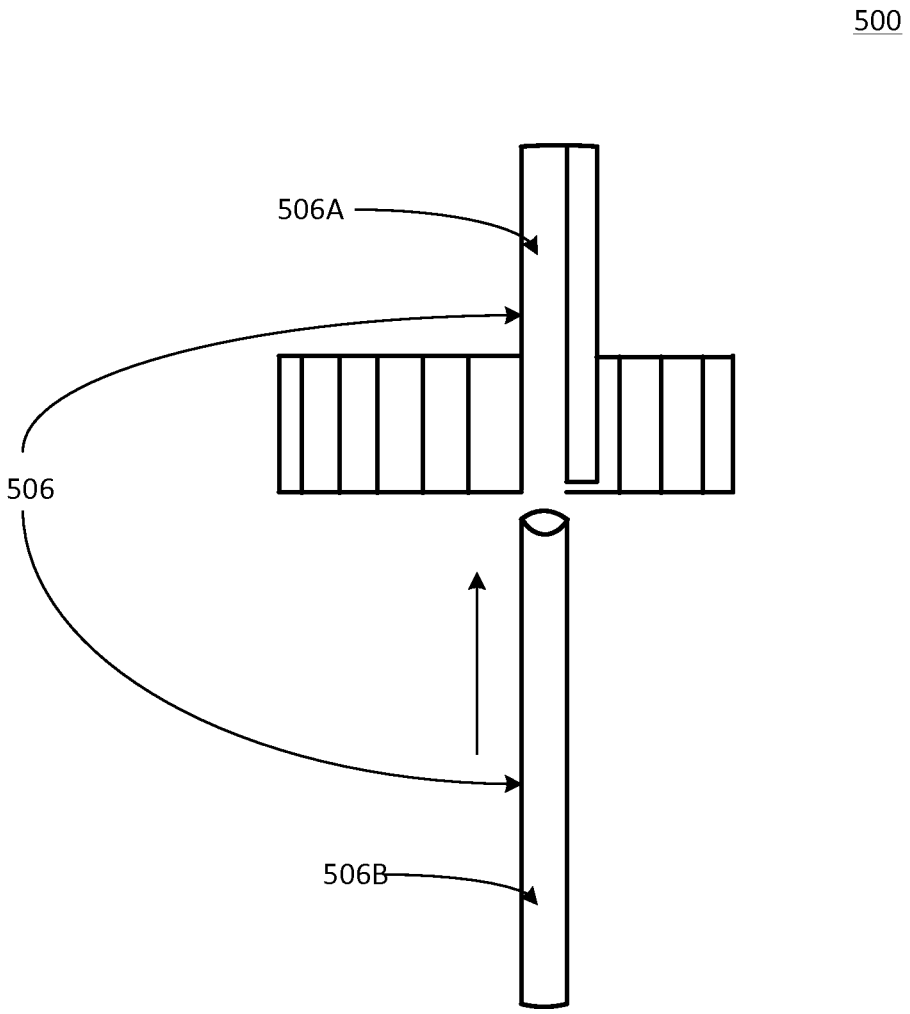
FIG. 5B shows an enclosure device according to another implementation of the present disclosure.

In some implementations, the first passageway 506 (or the breather tube) may include an attachable tube that may be attached to the cap 502. FIG. 5B shows a cross-section view of an enclosure device according to another implementation of the present disclosure. As shown in FIG. 5B, the first passageway 506 may include a first portion 506A fixedly attached to cap 502 and a second portion 506B that may be detachably attached to the first portion 506A. The first portion 506A may be a tube that is fixedly attached to the cap 502. In one implementation, the second portion 506B may be attached to the first portion 506A by inserting the second portion 506B into the first portion 506A. The first passageway 506 is formed when the first portion 506A and the second portion 506B are coupled together. When the first passageway is formed, the overall length of the first passageway 506 is greater than the length of the second passageway 508. The enclosure devices that include a portion of detachable as shown in FIG. 5B are easier to manufacture and thus cheaper to mass produce.

Figure 6:
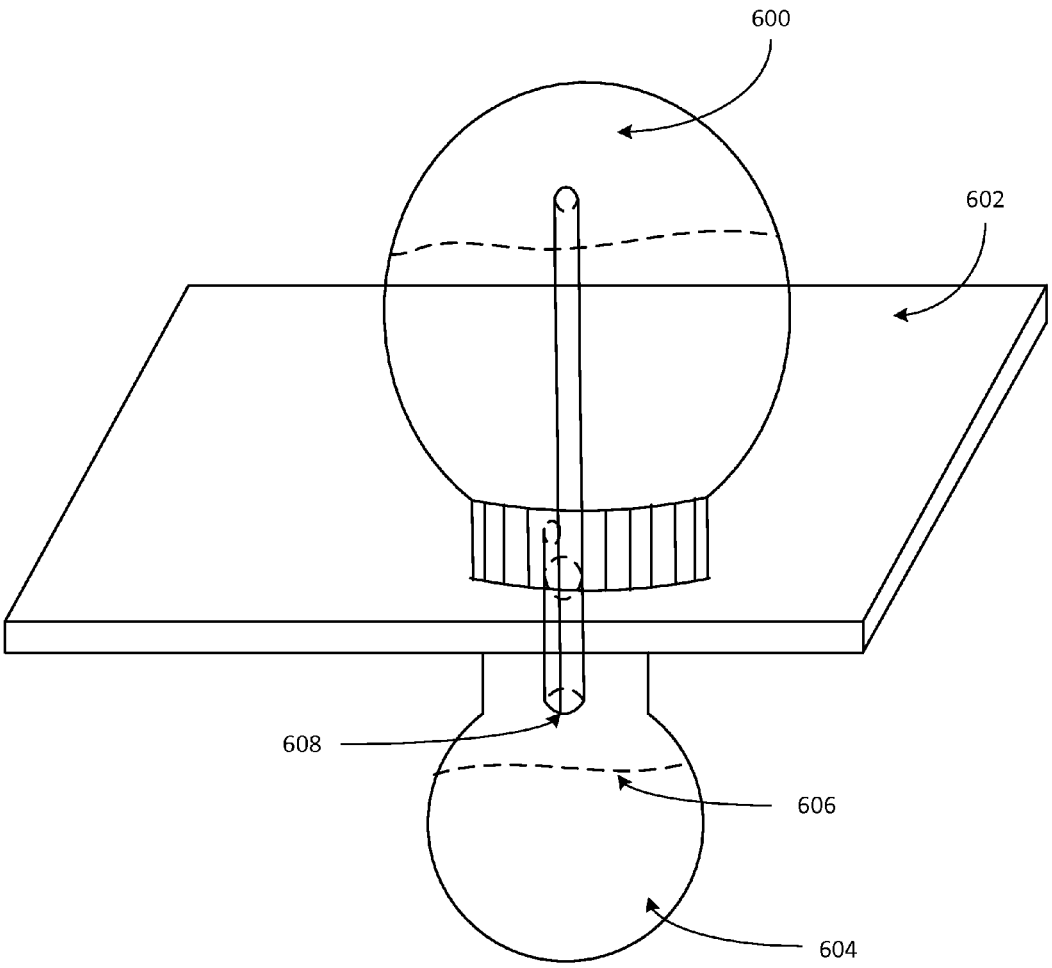
FIG. 6 shows how to use a refill bottle to fill a fluid reservoir mounted underneath a countertop according to an implementation of the present disclosure.

FIG. 6 shows how to use a refill bottle to fill a fluid reservoir mounted at a mounting point underneath a countertop according to an implementation of the present disclosure. As shown in FIG. 6, a fluid reservoir 604 may be mounted at a mounting point underneath a countertop 602. The fluid reservoir 604 may contain dish soap that may be withdrawn using a pump head (not shown) above the countertop 602. To refill the fluid reservoir 604 from above the countertop 602, a user may remove the pump head from the top to expose an opening leading to the passage to the fluid reservoir 604. The user may use the refill bottle 600 containing dish soap to fill the reservoir 604 from the top of the countertop 602. In one implementation, the refill bottle 600 may be one including a conduit similar to refill bottles 100, 400 as shown in FIGS. 1 and 4. The user may insert the conduit into the exposed passage to enable the tip 608 of the conduit reaching the chamber of the reservoir. The dish soap in the refill bottle 600 may then flow into reservoir 604 to fill up the chamber of reservoir 604. The breather tube may provide air pressure equilibrium between the chamber of the refill bottle 600 and the chamber of the fluid reservoir 604. This air pressure equilibrium allows for easy fluid flow from the refill bottle 600 to the fluid reservoir 604.

When the fluid in the fluid reservoir 604 is filled up to a fill level 606 that reaches the tip 608 of the conduit, any further filling shuts the air passage provided by the breather tube within the conduit. Without the benefit of the air passage provided by the breather tube, any further filling may reduce air volume and increase the air pressure in the chamber of the fluid reservoir 604, and decrease the air pressure in the chamber of the refill bottle 600. The pressure difference between these two chambers may stop of the fluid flow from the refill bottle 600 to the fluid reservoir 604. The stoppage of fluid flow may inform the user that the fluid reservoir has filled up.

In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an implementation" or "one implementation" or "an implementation" or "one implementation" throughout is not intended to mean the same implementation or implementation unless described as such.

Reference throughout this specification to "one implementation" or "an implementation" means that a particular feature, structure, or characteristic described in connection with the implementation is included in at least one implementation. Thus, the appearances of the phrase "in one implementation" or "in an implementation" in various places throughout this specification are not necessarily all referring to the same implementation. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. An apparatus comprising:

a container comprising an opening;

a cap to detachably enclose the opening, wherein the cap comprises a top surface that, when the cap is engaged onto the container, separates an interior space of the container from an exterior space of the container; and a conduit, attached to the cap, comprising a first passageway and a second passageway, both the first passageway and the second passageway connecting the interior space of the container to the exterior space of the container, wherein a length of the first passageway is greater than a length of the second passageway, wherein the first passageway comprises a first tube and the second passageway comprises a second tube, wherein the first tube comprises a first portion outside the container and a second portion inside the container, wherein the second tube comprises a first portion outside the container and a second portion inside the container, and wherein when the top surface of the cap is coupled to a through hole on a countertop, the first portion of the first tube and the first portion of the second tube are inside the through hole passing through a depth of the countertop, and an end of the first portion of second tube is to reach a neck portion of a liquid reservoir mounted underneath the countertop.

2. The apparatus of claim 1, wherein the container is to store a fluid.

3. The apparatus of claim 1, wherein a length of the second portion of the first tube is greater than a length of the second portion of the second tube.

4. The apparatus of claim 3, wherein the second portion of the first tube is a separate portion that is detachably attached to the first portion of the first tube.

5. The apparatus of claim 3, wherein a length of the second portion of the first tube is substantially the same as a length of the second portion of the second tube.

6. The apparatus of claim 1, wherein the conduit comprises a pipe, and wherein a divider is configured to separate the pipe into the first passageway and the second passageway.

7. The apparatus of claim 1, wherein the container comprises a bottle, wherein the bottle comprises a neck portion coupled to the opening, and wherein the second passageway is terminated in the bottle within the neck portion.

8. An apparatus comprising:

a cap to enclose an opening of a container, wherein the cap comprises a top surface that, when the cap is engaged onto the container, separates an interior space of the container from an exterior space of the container; and a conduit, attached to the cap, comprising a first passageway and a second passageway, wherein a length of the first passageway is substantially greater than a length of the second passageway, wherein the first passageway comprises a first tube and the second passageway comprises a second tube, wherein the first tube comprises a first portion outside the container and a second portion inside the container, wherein the second tube comprises a first portion outside the container and a second portion inside the container, and wherein when the top surface of the cap is coupled to a through hole on a countertop, the first portion of the first tube and the first portion of the second tube are inside the through hole passing through a depth of the countertop, and an end of the first portion of second tube is to reach a neck portion of a liquid reservoir mounted underneath the countertop.

9. The apparatus of claim 8, further comprising a container comprising an opening, wherein the cap is to enclose the opening.

10. The apparatus of claim 9, wherein a length of the second portion of the first tube is greater than a length of the second portion of the second tube.

11. The apparatus of claim 10, wherein a length of the second portion of the first tube is substantially same as a length of the second portion of the second tube.

12. The apparatus of claim 10, wherein the second portion of the first tube is a separate portion that is detachably attached to the first portion of the first tube.

13. The apparatus of claim 8, wherein the conduit comprises a pipe, and wherein a divider is configured to separate the pipe into the first passageway and the second passageway.

14. A bottle for refilling a fluid dispenser, the bottle comprising:

a body to store fluid;

a sprout tube to connect an interior of the body to exterior, wherein the sprout tube comprises a first portion outside the body and a second portion inside the body; and a breather tube to connect the interior of the body to the exterior, wherein the breather tube comprises a first portion outside the body and a second portion inside the body, wherein the second portion of the breather tube is substantially longer than the second portion of the sprout tube, wherein when the bottle is coupled to a through hole on a countertop, the first portion of the sprout tube and the first portion of the breather tube are inside the through hole passing through a depth of the countertop, and an end of the first portion of breather tube is to reach a neck portion of a liquid reservoir mounted underneath the countertop.

15. The bottle of claim 14, further comprising an outlet on the body, wherein a fluid is to be added to the body through the outlet.

16. The bottle of claim 15, further comprising a cap to enclose the outlet.

17. The bottle of claim 14, wherein a length of the first portion of the sprout tube is substantially the same as a length of the first portion of the breather tube.

18. The bottle of claim 14, wherein the sprout tube and the breather tube are part of a same conduit and are separated by a divider.

19. The bottle of claim 14, wherein the sprout tube and the breather tube are two separate tubes.

* * * * *